United States Patent [19]

Vilcsek

[11] Patent Number: 4,615,196

[45] Date of Patent: Oct. 7, 1986

[54] TWO ROLLER, TILTING BRIDGE TYPE MACHINE FOR THE PRODUCTION OF TANK BOTTOM

[75] Inventor: Endre Vilcsek, Budapest, Hungary

[73] Assignee: Mezögép Nyiregyháza, Nyiregyháza, Hungary

[21] Appl. No.: 753,343

[22] Filed: Jul. 10, 1985

Related U.S. Application Data

[63] Continuation of Ser. No. 469,064, Feb. 23, 1983, abandoned.

[30] Foreign Application Priority Data

Feb. 24, 1982 [HU] Hungary ..... 556/82

[51] Int. Cl.[4] ..... B21D 22/18

[52] U.S. Cl. ..... 72/85; 72/86

[58] Field of Search ..... 72/80, 84, 85, 86, 87

[56] References Cited

U.S. PATENT DOCUMENTS

| | | | |
|---|---|---|---|
| 601,566 | 3/1898 | Huston | 72/84 |
| 3,372,567 | 3/1968 | Jensen et al. | 72/80 |
| 3,427,846 | 2/1969 | Viltschek et al. | 72/85 |
| 4,130,205 | 12/1978 | Luthi | 92/26 |
| 4,322,960 | 4/1982 | Bosch | 72/83 |

FOREIGN PATENT DOCUMENTS

| | | | |
|---|---|---|---|
| 1452756 | 3/1969 | Fed. Rep. of Germany | 72/87 |
| 2065524 | 7/1981 | United Kingdom | 72/84 |

*Primary Examiner*—Lowell A. Larson

*Attorney, Agent, or Firm*—Gabriel P. Katona

[57] ABSTRACT

The machine according to the invention is used for shaping bodies of rotation—preferably tank bottoms—fixed with radius, by metal spinning between two rollers without the need of costly metal spinning mushroom.

The tank bottom is shaped from sheet metal disc between the inner shaped and driven roller forming the arc corresponding to the curvature to be shaped, as well as the opposite free-running roller producing the necessary compressive force. The inner and outer rollers are arranged on a closed frame construction provided with two shanks on which the center of tilting is arranged as to correspond to the required arc. The large radius is formed by the simultaneous tilting of the inner and outer rollers. The flanging is carried out by rolling over the inner shaped roller in such a way that the tilting bridge is fixed and the outer roller moves on in radial direction with the aid of a sledge.

3 Claims, 4 Drawing Figures

TWO ROLLER, TILTING BRIDGE TYPE MACHINE FOR THE PRODUCTION OF TANK BOTTOM

This is a continuing application of application Ser. No. 469,064, filed on Feb. 23, 1983, now abandoned.

FIELD AND BACKGROUND OF THE INVENTION

The two roller, tilting bridge type machine is suitable for the production of bodies of roatation, preferably tank bottoms fixed with radius, by metal spinning, without the need of costly metal spinning mushroom.

Earlier the tank bottoms were produced with hot pressing. In order to save the substantial technical expenditures necessary for the production of hot pressing equipment, the production of tank bottoms was started with new technology, i.e. metal spinning; however the large diameter required the use of large-size metal spinning mushroom.

In order to eliminate the use of the large-size metal spinning mushrooms, two processes were worked out.

According to one of the processes the large radius is formed on the pressing machine with a tool acting on a small surface in several steps, and the small radius is formed on another flanging press. The machines of the German firm Schleifenbaum and Steinmetz and of the Italian firm Boldrini are operating with such technology, where two machines and an additional costly manipulator for servicing the pressing machine are necessary due to the large dimensions and significant weight of the sheet metal discs.

According to another process the tank bottom is shaped between two rollers, and the shape of the inner roller corresponds to the flange of the tank bottom, i.e. to the small radius.

The machines according to Hungarian patent specification No. 153 215 and GFR patent specification Nos. DT 1 752 914 and DT 1 804 669 were designed for the latter process, where the inner shaped roller forms the large radius of the tank bottom moving together with the outer roller, then by the stepped movement of the inner roller, the outer roller shapes the flange of the tank bottom, i.e. the small radius by rolling the edge of the sheet metal onto the inner shaped roller. The radial centre is adjustable according to the large radius of the disc to be shaped, while the shape of the inner roller is selected according to the small radius.

Hungarian patent specification No. 175 686 is aimed at the elimination of the shortcomings of the machines described in the Hungarian patent specification No. 153 215 and GFR patent specification Nos. 1 752 914 and 1 804 669, according to which the inner and outer tilting bridges carrying the inner shaped and outer pressure roller, tilt around the centre of roation placed into the radial centre of the work piece and, the synchronous movement, to be disengaged upon flanging, is ensured with lock pins.

The machine produced according to Hungarian specification patent No. 175 686 proved the advantages, however since the bridges carrying the inner and outer rollers were shaped separately, the following two adverse phenomena came to light. One of them is that the compressive force arising from the rolling shaping becomes closed through the pin in the centre of rotation, consequently the outer and inner bridges, as well as the journal in the centre of rotation of the tilting, have to be dimensioned according to this force, which is 200–300 kN in case of an 18 mm steel plate. The other adverse phenomenon is that the synchronous movement of the inner and outer rollers has to be ensured with hydraulically actuated pins for forming the large radius, and these pins have to be disengaged, or the inner bridge is to be fixed prior to commencement of the flanging. Movement of the pins performing the fixing of the inner bridge and, thereafter, the disengagement of the pins ensuring the synchronous movement take time, during which the pressure roller, in lack of feed, presses the work piece along the penetration line of the large radius and small radius of the flanging, where it leaves a visible trace. A farther disadvantage of this solution resides in that the holes used for securing the inner bridge are fixed for each diameter, and the diameter of the work pieces can be corrected only by modification of the shaped inner roller.

SUMMARY OF THE INVENTION

The present invention is aimed at the elimination of the shortcomings of the machine described in Hungarian patent specification No. 175,686, i.e. at the elimination of the rigidity given by the two tilting mechanisms and, at the same time, at simplifying the mechanisms actuated at the meeting point of the large and small radii.

In the machine developed according to the present invention, the inner shaped driven roller and outer roller, as well as their carrier sledge are arranged on a closed frame construction. The pins ensuring the centre of tilting are arranged on the wings of the frame construction in the direction of the radial centre, the position of which, i.e. the distance from the inner roller, can be varied according to the large radius of the work piece to be shaped. The suitably dimensioned closed frame construction ensures adequate rigidity during shaping even in case of high compressive forces. A further advantage of the present invention resides in that only one tilting bridge is used, common for both rollers, thus the synchronous movement of the two rollers is automatically ensured during the process of tilting, i.e. the formation of the large radius. Upon completion of the large radius the tilting stops and the outer roller moves further with the aid of the carrier sledge in order to form the small radius by rolling the edge of the sheet metal disc onto the inner shaped roller, when the clamping device, mounted on the tilting cylinder, has stopped the tilting, i.e. when the closed frame construction is fixed. Diameter of the tank bottom to be produced can be corrected, increased or reduced, by varying the point of clamping. The tilting angle of the closed frame construction is determined by the angular displacement adjusting device, and upon reaching the required angle of tilting, the same device stops the pair of tilting cylinders and the hydraulic cylinders of the clamping devices mounted on the pair of cylinders and, at the same time, it brings into motion the hydraulic motor ensuring the movement of the sledge of the pressure roller in the direction of the flange.

In the machine according to Hungarian patent specification No. 175 686 the pair of pins ensuring the centre of tilting are arranged on the radially moving cradle, which sets the pair of pins to the radius of the work piece with the aid of actuating mechanism. This allows to produce products of numerous radii in steps. The number of the steps is restricted by the pins and diameter of the bushings mounted in the machine body or into the shank of the tilting bridge.

When only a certain limited number of diameter variations are to be produced on a given machine, using it as a single purpose machine, then instead of, complicated pin-actuating cradle, it is advisable to use a pair of pins in each radial centre moving around their axis to be mounted either on the machine body, or on the shank of the bridge, and the pin in the radial centre is pushed into the bush, serving as the centre of tilting, arranged in the other machine part with the aid of a mechanism, suitably a hydraulic cylinder.

BRIEF DESCRIPTION OF THE DRAWINGS

The invention is illustrated in detail in the enclosed drawing, showing a preferred construction given by way of example, in which.

DESCRIPTION OF THE PREFERRED EMBODIMENT

Figure 1:
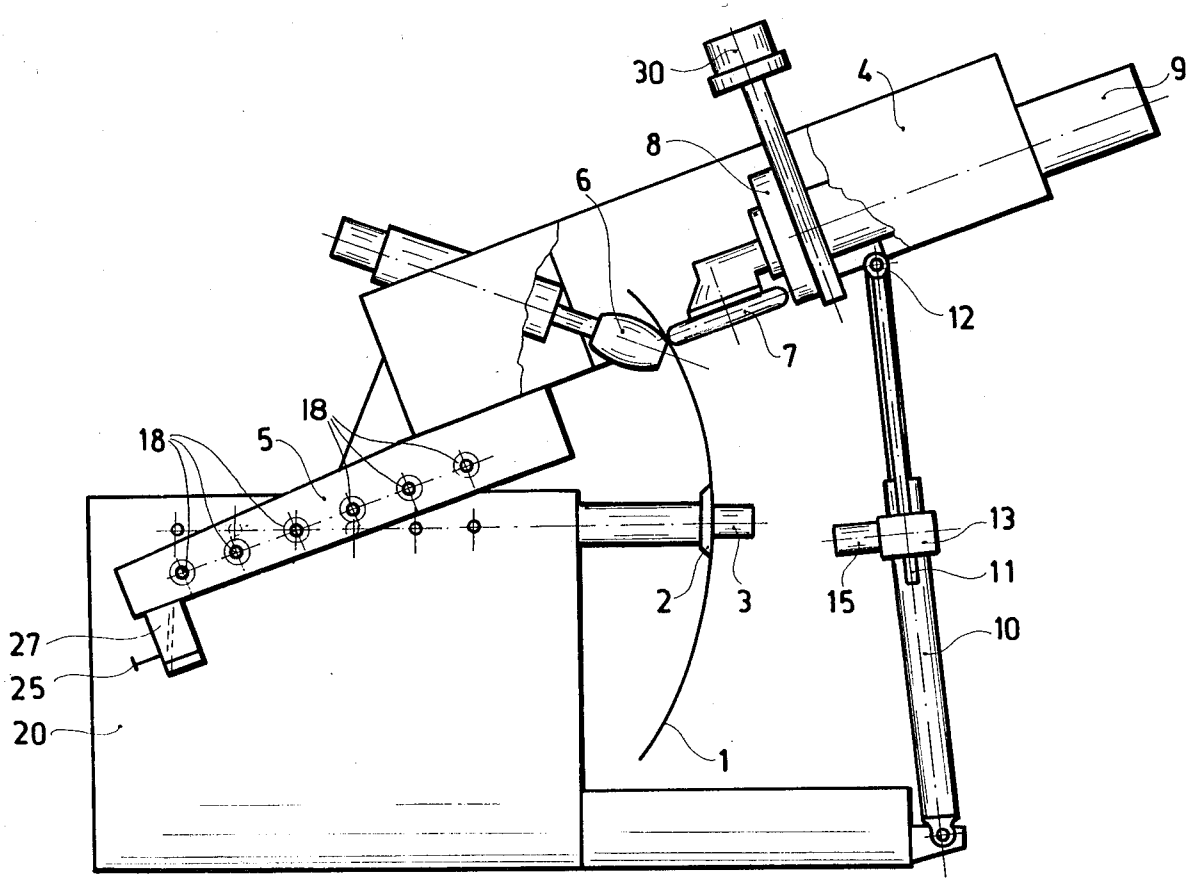
FIG. 1: Side view of the machine in the position when the large radius of the work piece is completed and the flanging begins.
Figure 2:
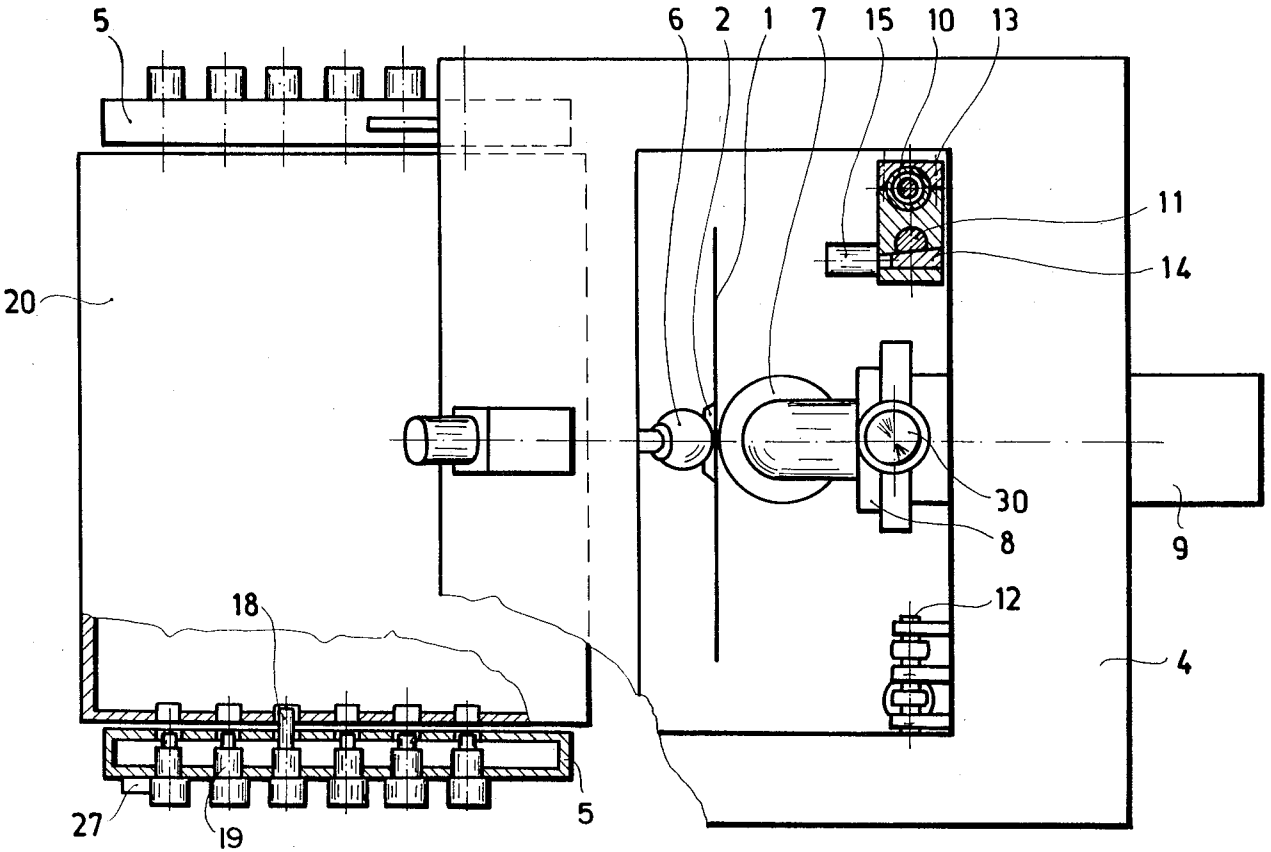
FIG. 2: Top view of the machine in initial position.
Figure 3:
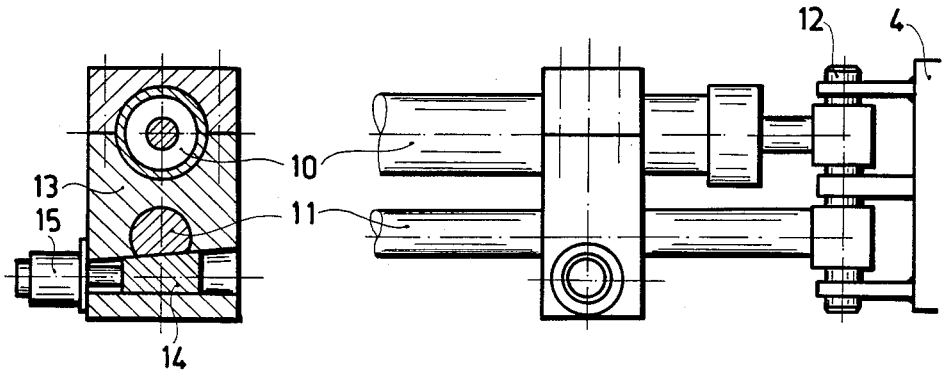
FIG. 3: Clamping device.
Figure 4:
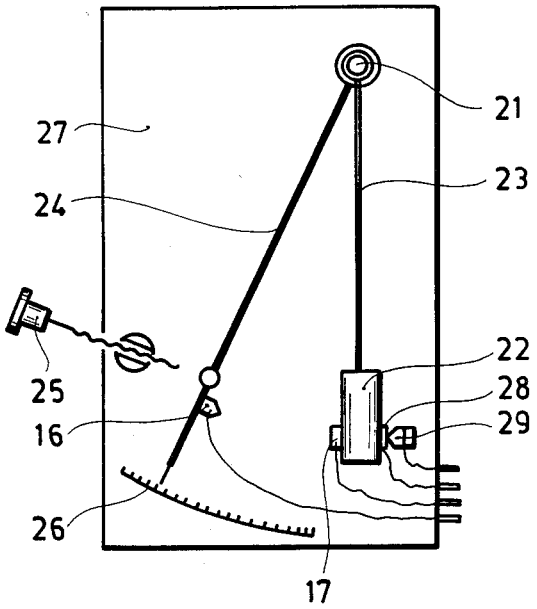
FIG. 4: Mechanism for adjusting the angular displacement.

The work piece 1 provided with a hole is pressed onto the driven clamping disc 2 by disc clamp 3. The shaft and bearing of the driven clamping disc 2 are mounted within the machine body 20. The tank bottom is shaped between two rollers, i.e. the inner driven shaped supporting roller 6 and the outer free-running pressure roller 7. Formation of the large radius of the work piece is determined by the path of the inner shaped roller 6. The inner shaped roller 6 or its bearing is rigidly fixed on the side of the closed tilting frame construction 4 facing the centre of tilting. The pressure roller 7 is arranged on the opposite side of the closed tilting frame construction 4 mounted on the sledge 8 moving in the direction of the flange. The sledge 8 is mounted on the press head 9. The closed tilting frame construction 4 swings around one of the pins 18 located in the centre of tilting i.e. in the center of radius of the workpiece 2 and being actuated by the hydraulic cylinder 19 connecting the machine body 20 and shank 5 in the centre of the required radius. The number of large radii which can be set corresponds to the number of pins 18. The large radius is formed by tilting the closed frame construction 4 with a pair of tilting cylinders 10. Upon reaching the flange part, contacts 16, 17 of the mechanism 27 limiting the angle of tilting stop the tilting through an electrohydraulic switch 25, and fix the closed tilting frame construction with the aid of brake shoe 14 and stay rod 11 actuated with cylinder 15 in the clamping device 13 mounted on the tilting cylinder 10, and at the same time the contacts 16, 17 switch on the hydraulic motor 30 which moves the sledge 8 carrying the pressure roller 7 in the direction of the flange. That is, motor 30 is turned on when the tilting of frame 4 has reached its limit set by mechanism 27 representing the meeting point of the small and large radii of the workpiece 1. The stay rod 11 and piston rod of the tilting cylinder 10 are mounted on pin 12 suspended on the closed tilting frame construction 4. The flanging, i.e. the small radius of the work piece is formed in one or several steps by actuation of the motor 30 and thereby of the sledge 8 and press head 9 after the rollers 6 and 7 have reached the location where the large radius of the workpiece 1 ends and the small radius should start and the small radius or flange will be formed by roller 7.

Upon completion of the work piece, return of the closed tilting frame construction 4 into normal position is ensured upon meeting of the contacts 28, 29. A vertical arm 23 provided with counterweight 22 and an arm 24, the angular position of which is adjustable with an adjusting screw 25 are arranged in the mechanism 27 limiting the angle of tilting mounted on shank 5 of the closed tilting frame construction 4. The angular position of arm 24 is indicated by scale 26. Arms 23–24 with contacts 16, 17 are mounted on pin 21. These contacts 16, 17 engage following the tilting of shank 5 of the closed frame construction 4 at the adjusted angle.

The invention has the following advantages against the known apparatuses:

in case of metal spinning between two rollers the costly pressing tool used for metal spinning becomes unnecessary, the inner and outer rollers are arranged on the same rigid frame construction and their synchronous movement during formation of the large radius is ensured, the common closed frame construction makes the two separate bridges dimensioned for maximum compressive force unnecessary, the compressive- and supporting forces are locked through the closed frame construction, thus only a fraction of the tilting force has to be taken into consideration for dimensioning of the pin in the centre of tilting, the change-over is very fast at transition of the large radius and flanging, the oil ensuring the tilting starts immediately the hydraulic motor which actuates the sledge simultaneously with the clamping through actuation of the change-over valve, the angle of tilting is easily and sensitively delimited.

What we claim is:

1. A machine comprising a pair of rollers (6,7) comprising an inner and an outer roller and a bridge for the production of bodies of rotation including a flange, said bridge undergoing a tilting during said production, and an adequately rigid, closed tilting frame (4) for mounting said rollers opposite to each other, means for rotatably mounting a workpiece on which a larger and a smaller flange-like body of rotation is to be formed having predetermined different radii, a mechanism (20) for limiting the tilting, a shank (5) coupling said frame and said mechanism, means for longitudinally adjusting said shank while retaining said shank in a predetermined radial center (18) of the workpiece being operated on by the inner one of said pair of rollers (6, 7) for shaping said workpiece (1) by said pair of rollers (6, 7), one of said pair of rollers is a shaped driven roller (6) and the other of said rollers is an outer free-running pressure roller (7), sledge means for mounting the pressure roller, a press head (9) for mounting said sledge means opposite to said shaped driven roller for providing between said rollers a pointedly directed pressure on said body by rotation, said sledge (8) moving said pressure roller (7) for forming said flange of the workpiece (1), further comprising a clamping device (13) for fixing the closed tilting frame (4) after the tilting, said clamping device (13) including a brake shoe (14), a hydraulic cylinder (15) for actuating said brake shoe and holding a lap-jointed stay-rod (11) mounted on said tilting frame and on a common suspension pin (12) of the press head (9), a tilting cylinder (10) for actuating said tilting frame (4) said stay-rod coupling said tilting cylinder to said suspension pin, further comprising limit contacts (16, 17) for stopping the tilting frame upon completion of the large flange-like body, said sledge means moving said outer roller further for forming the smaller flange-like body by rolling the edge of said body of rotation over said inner shaped roller.

2. The machine as claimed in claim 1, comprising a pair of pins (18) located in the radial center of said workpiece and being in actuating connection with a hydraulic cylinder means (19) arranged on both sides of the machine in the center of tilting corresponding to the larger and smaller body of rotation of the workpiece to be produced with the machine, for coupling the machine and said shank (5) through said pins in the predetermined radial center of the inner one of said pair of rollers.

3. The machine as claimed in claim 2, wherein said hydraulic cylinder means (19) are arranged on said shanks (5) for coupling a body portion (20) of said machine and shanks (5) through said pins thereof.

* * * * *